US009243514B2

(12) United States Patent
Krotzer, Jr. et al.

(10) Patent No.: US 9,243,514 B2
(45) Date of Patent: Jan. 26, 2016

(54) HYBRID GAS TURBINE BEARING SUPPORT

(71) Applicant: United Technologies Corporation, Hartford, CT (US)

(72) Inventors: W. Samuel Krotzer, Jr., Glastonbury, CT (US); Michael D. Greenberg, Bloomfield, CT (US); Kevin W. Schlichting, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 561 days.

(21) Appl. No.: 13/678,705

(22) Filed: Nov. 16, 2012

(65) Prior Publication Data

US 2014/0140823 A1 May 22, 2014

(51) Int. Cl.
*F01D 25/16* (2006.01)
*F01D 5/28* (2006.01)

(52) U.S. Cl.
CPC ..... *F01D 25/162* (2013.01); *F01D 5/28* (2013.01); *F05D 2230/233* (2013.01); *F05D 2230/234* (2013.01); *F05D 2300/175* (2013.01); *Y10T 29/49236* (2015.01)

(58) Field of Classification Search
CPC ..... F01D 5/02; F01D 5/28; F01D 25/162
USPC ..... 416/241 R
See application file for complete search history.

(56) References Cited

U.S. PATENT DOCUMENTS

| | | | | | |
|---|---|---|---|---|---|
| 4,335,997 | A | * | 6/1982 | Ewing et al. | 416/185 |
| H647 | H | * | 7/1989 | Johnson et al. | 29/417 |
| 5,100,050 | A | * | 3/1992 | Krueger et al. | 228/265 |
| 5,106,012 | A | * | 4/1992 | Hyzak et al. | 228/265 |
| 5,161,950 | A | | 11/1992 | Krueger et al. | |
| 7,891,952 | B2 | | 2/2011 | Wines et al. | |
| 8,187,724 | B2 | * | 5/2012 | Rice | 428/680 |
| 8,262,817 | B2 | * | 9/2012 | Marshall et al. | 148/527 |
| 2006/0008352 | A1 | | 1/2006 | Segletes et al. | |
| 2009/0269193 | A1 | | 10/2009 | Larose et al. | |
| 2010/0215978 | A1 | | 8/2010 | Rice | |
| 2012/0267344 | A1 | | 10/2012 | Cui et al. | |

OTHER PUBLICATIONS

"Inconel Alloy 718" Special Metals Corporation. Sep. 2007. Publication No. SMC-045. 27 pages. <www.specialmetals.com>.

"Haynes 282 Alloy" Haynes International. 2008. 27 pages. <www.haynesintl.com>.

Ono, Yoshinori et al. "High-Cycle Fatigue Properties at Cryogenic Temperatures in Inconel 718 Nickel-based Superalloy" Materials Transactions. vol. 45, No. 2. 2004. pp. 342-345.

Boehlert, C.J. et al. "A comparison of the microstructure and creep behavior of cold rolled Haynes 230 alloyTM and Haynes 282 alloyTM" Materials Sceience and Engineering A. 528 (2011) pp. 4888-4898.

International Search Report and Written Opinion, dated Feb. 6, 2014, for PCT Application No. PCT/US2013/066502, 15 pages.

* cited by examiner

*Primary Examiner* — Ninh H Nguyen
(74) *Attorney, Agent, or Firm* — Kinney & Lange, P.A.

(57) ABSTRACT

A hybrid radial gas turbine engine component comprises an inner hub portion joined to an outer ring portion. The inner hub portion is a first alloy and operates at temperatures less than 1200° F. The outer ring portion is a second alloy and is designed to withstand extended periods at temperatures greater than 1200° F.

9 Claims, 6 Drawing Sheets

HYBRID GAS TURBINE BEARING SUPPORT

BACKGROUND

This invention relates generally to radial structural components in gas turbine engines, and specifically to components with portions operating at temperatures exceeding 1200° F. In particular, the invention concerns replacing selected portions of a component with materials resistant to high temperature degradation.

Gas turbine engines are configured around a core comprising a compressor, a combustor and a turbine, which are arranged in flow series with a forward (upstream) inlet and an aft (downstream) exhaust. The compressor compresses air from the inlet, which is mixed with fuel in the combustor and ignited to produce hot combustion gas. The combustion gas drives the turbine, and is exhausted downstream. Typically, compressed air is also utilized to cool downstream engine components, particularly turbine parts exposed to hot working fluid flow.

The turbine section may be coupled to the compressor via a common shaft, or using a series of coaxially nested shaft spools, which rotate independently. Each spool includes one or more compressor and turbine stages, which are formed by alternating rows of blades and vanes. The working surfaces of the blades and vanes are formed into airfoils, which are configured to compress air from the inlet (in the compressor), or to extract energy from combustion gas (in the turbine).

In ground-based industrial gas turbines, power output is typically provided in the form of rotational energy, which is transferred to a shaft and used to drive a mechanical load such as a generator. Weight is not as great a factor in ground-based applications, and industrial gas turbines can utilize complex spooling systems for increased efficiency. Ground-based turbines are also commonly configured for combined-cycle operations, in which additional energy is extracted from the partially-cooled exhaust gas stream, for example by driving a steam turbine.

In gas turbine engine design, there is a constant need to balance the benefits of increased pressure and combustion temperature, which tend to improve engine performance, with accompanying wear and tear on the engine components, which tend to decrease service life. In particular, there is a need for materials that resist the increased thermal exposure in the compressor or turbine section of modern gas turbine engines.

SUMMARY

A hybrid radial gas turbine engine component comprises an inner hub portion joined to an outer ring portion. The inner hub portion operates at temperatures less than 1200° F. and is a first alloy. The outer ring portion is formed from a second alloy designed with mechanical properties and microstructures to withstand extended periods at temperatures greater than 1200° F. with greater yield strength and corresponding creep strength than the first alloy at those temperatures.

DETAILED DESCRIPTION

Figure 1:
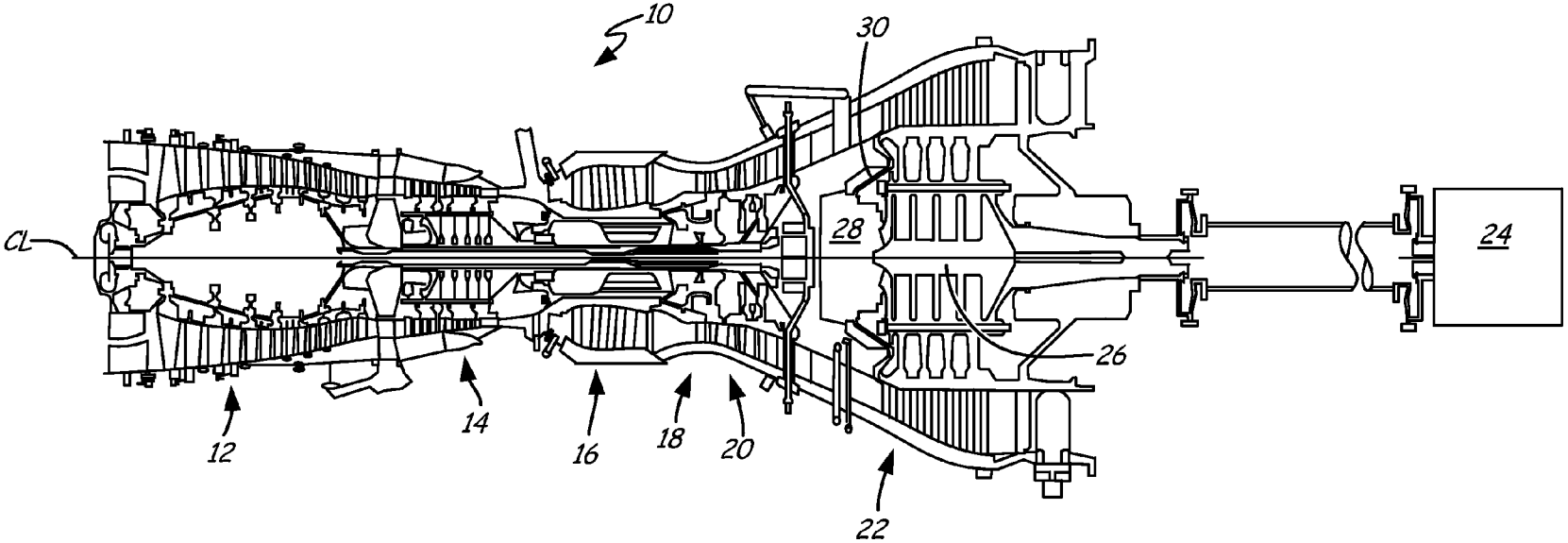
FIG. 1 is a cross-sectional view of an industrial gas turbine engine.

FIG. 1 is a cross section of industrial gas turbine engine 10, which is circumferentially disposed about a central, longitudinal axis or axial centerline CL. Gas turbine engine 10 includes in flow series order from front to rear, low pressure compressor 12, high pressure compressor 14, combustor 16, high pressure turbine 18, and low pressure turbine 20. Power turbine 22 is attached to the rear of low pressure turbine 20 and is connected to electrical generator 24.

As known in the art of gas turbines, incoming ambient air is serially pressurized by low pressure compressor 12 and high pressure compressor 14. The pressurized air is sent to combustor 16, where it mixes with fuel and is ignited. Once burned, the resulting combustion products expand serially through high pressure turbine 18, low pressure turbine 20, and power turbine 22 thereby producing usable work. High pressure turbine 18 and low pressure turbine 20 drive high pressure compressor 14 and low pressure compressor 12 through high and low rotor shafts. Power turbine 22 powers, for example, electrical generator 24. The present application also applies to aero engines, and engines with more or fewer sections than illustrated.

Figure 2:
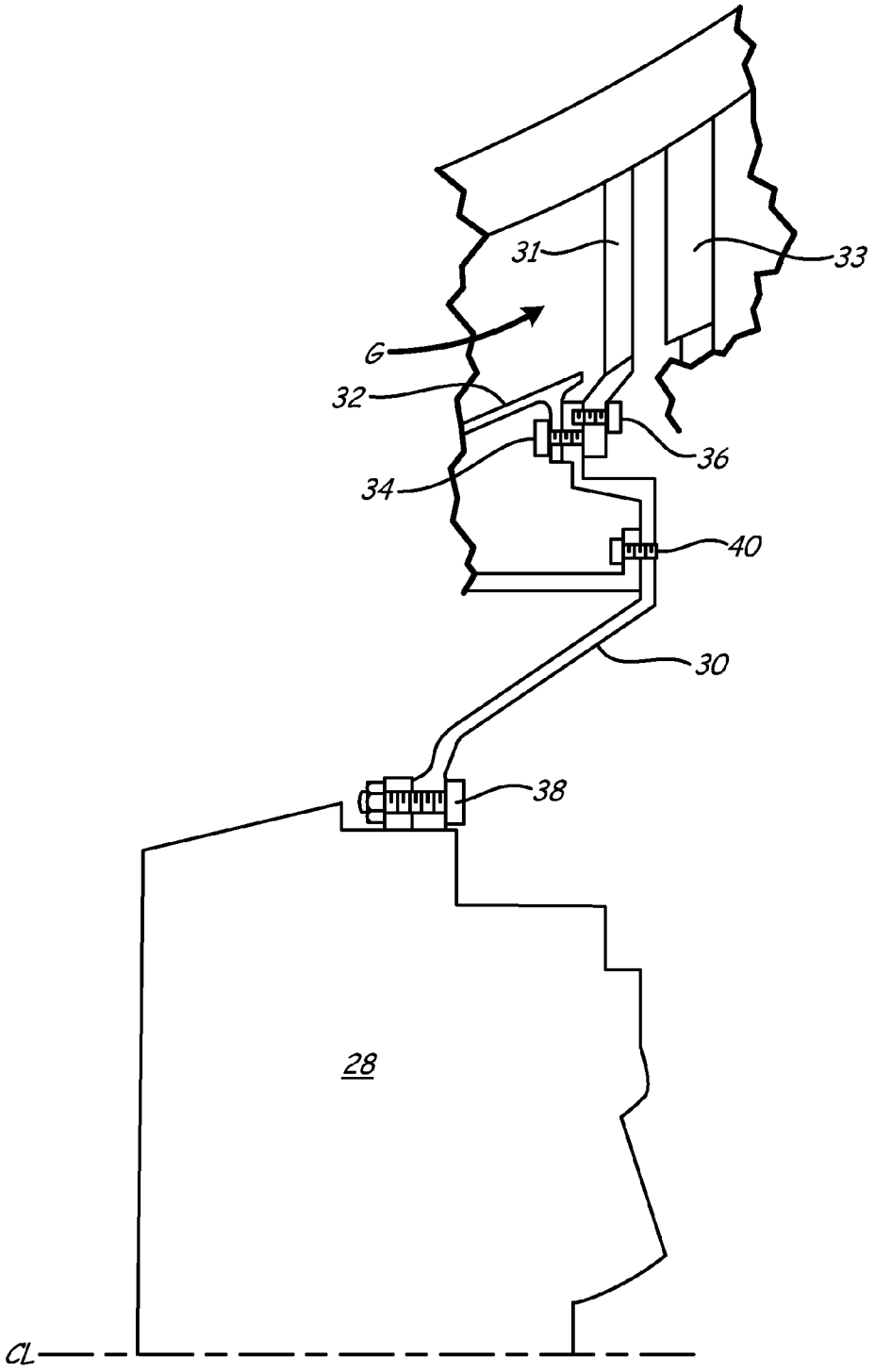
FIG. 2 is a detailed cross-sectional view of a radial bearing support disk.

Power turbine 22 comprises a spool of airfoils and vanes mounted on shaft 26 for generating additional power from working fluid exhausted from low pressure turbine 20. Shaft 26 is supported by bearing assembly 28 which is supported by bearing support disk 30. A detailed cross sectional view of bearing assembly 28 and bearing support disk 30 is shown in FIG. 2. Bearing support disk 30 is attached to inner shroud 32 by bolts 34 and 36 in the vicinity of hot gas path G and to bearing assembly 28 at its inner diameter by bolts 38. Midspan bolt 40 supports internal structures not shown. Exemplary fixed vane 31 attached to inner shroud 32 and movable airfoil 33 are shown in gas path G.

The efficiency of a turbine engine scales directly as the differences in the input and exhaust temperatures of the turbine. As a result, inlet design temperatures have been continually increasing as turbine engines develop. Most radial structural components in a turbine engine experience the highest temperatures at the outer edges of disk shaped components exposed to the hot gas path. An example and non-limiting embodiment of the present invention comprises bearing support disk 30 in power turbine 22 of industrial gas turbine engine 10 as shown in FIGS. 1 and 2.

Figure 3:
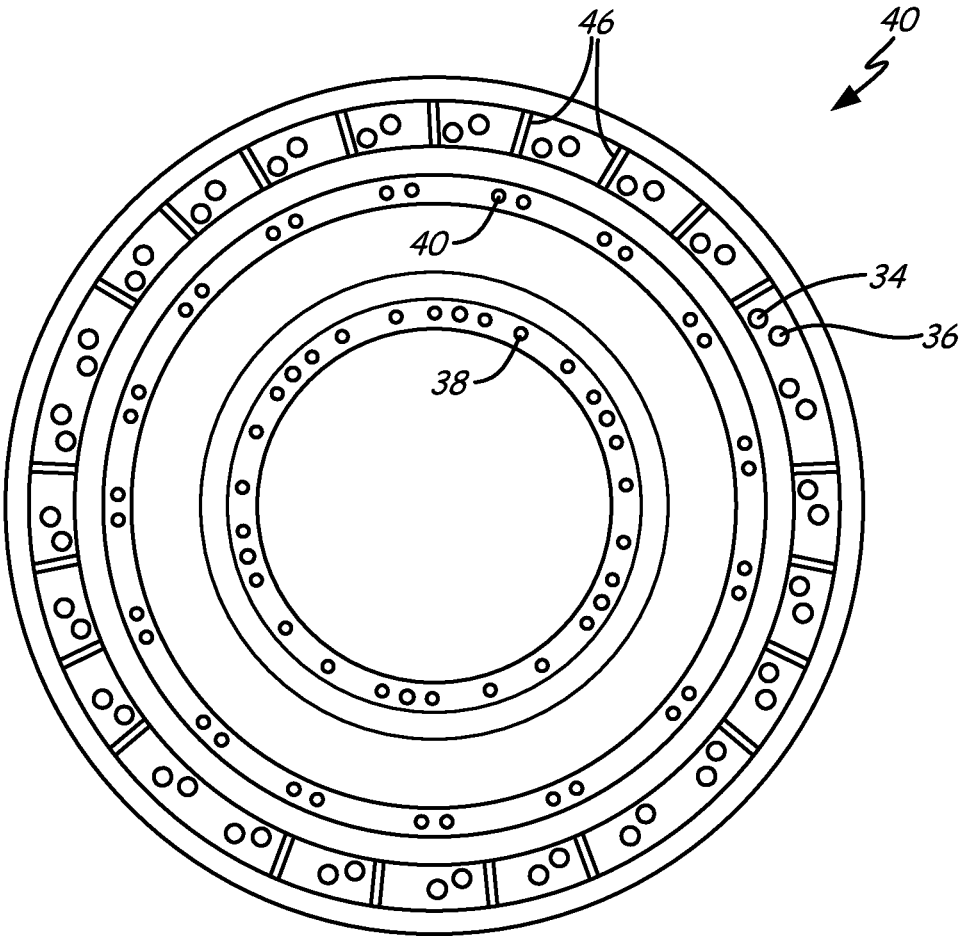
FIG. 3 is a front view of a radial bearing support disk.

A front view of bearing support disk 30 is shown in FIG. 3 with the bolt holes numbered as shown in FIG. 2. Radial slots 46 are indicated on disk 30 in the vicinity of bolt holes 34 and 36.

In the example, disk 30 may be fabricated from Inconel 718 alloy, a high-strength, corrosion-resistant nickel, iron, chromium alloy considered useful for extended use in turbine applications requiring yield and tensile strengths of 150 and 170 ksi respectively at maximum temperatures of about 1200° F. The nominal composition in weight % of Inconel 718 is:

| C | Cr | Ni | Mo | Fe | Co | Nb | Ti | Al |
|---|---|---|---|---|---|---|---|---|
| 0.04 | 19.0 | 52.5 | 3.0 | 19.0 | <1.0 | 5.3 | 0.9 | 0.5 |

plus alloying additions. Disk 30 may be formed by forging or casting.

The alloy is strengthened by age hardening following a solution anneal at a nominal temperature of 1700-1950° F., followed by a water quench. Age hardening at 1150-1200° F. for 18 to 20 hours results in precipitation of gamma prime and gamma double prime strengthening phases. Gamma prime is a coherent, intermetallic, face centered cubic phase with a nominal composition of $Ni_3(Al,Ti)$. Gamma double prime is a coherent, body-centered tetragonal intermetallic phase with a nominal composition of $Ni_3Nb$. Both strengthening phases act as obstacles to creep and other means of elevated temperature deformation.

Figure 4:
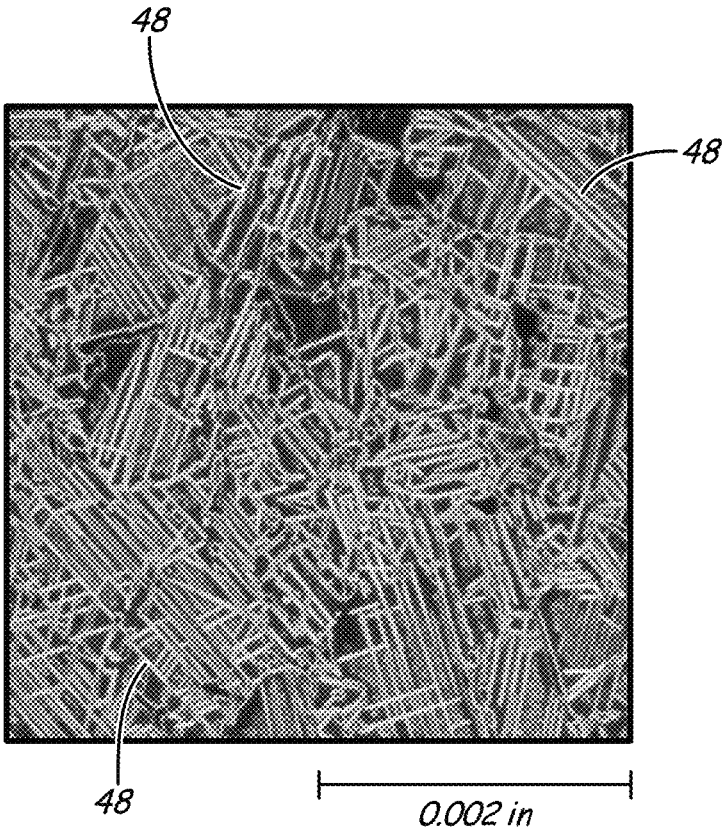
FIG. 4 shows a microstructure of Inconel 718 alloy showing an acicular or needle-like delta phase precipitate.

As a result of proximity to hot gas path G during operation, the temperature of outer radial portions of bearing support disk 30 can approach or exceed 1200° F. If these portions of disk 30 remain at temperatures over 1200° F. for extended periods, metallurgical alterations may occur that may result in loss of ductility, crack initiation, and eventually macroscopic fracture, particularly at regions of high stress, such as radial slots 46 machined in the outer diameter of bearing support 30 as shown in FIG. 3. During service at temperatures at and above 1200° F., phase transformations may occur, during which the coherent gamma prime and gamma double prime strengthening phases may dissolve and reprecipitate as incoherent delta phase. Delta phase has an orthorhombic structure with a composition of $Ni_3(Nb_8Ti_2)$. The delta phase precipitates as needles and plate structures and results in unacceptable lower ductility and strength. The presence of delta phase is easily confirmed by metallographic examination. In the example of the present invention, FIG. 4 shows the microstructure of the outer radial region of disk 30 in the vicinity of radial slots 46 in FIG. 3. The acicular or needle-like microstructure of delta phase 48 is apparent.

The loss of lifetime as a result of mechanical property degradation of the Inconel 718 component of the present invention due to delta phase formation and other microstructural events, after extended service in the vicinity of 1200° F., prompted the inventive embodiment discussed below.

Figure 5:
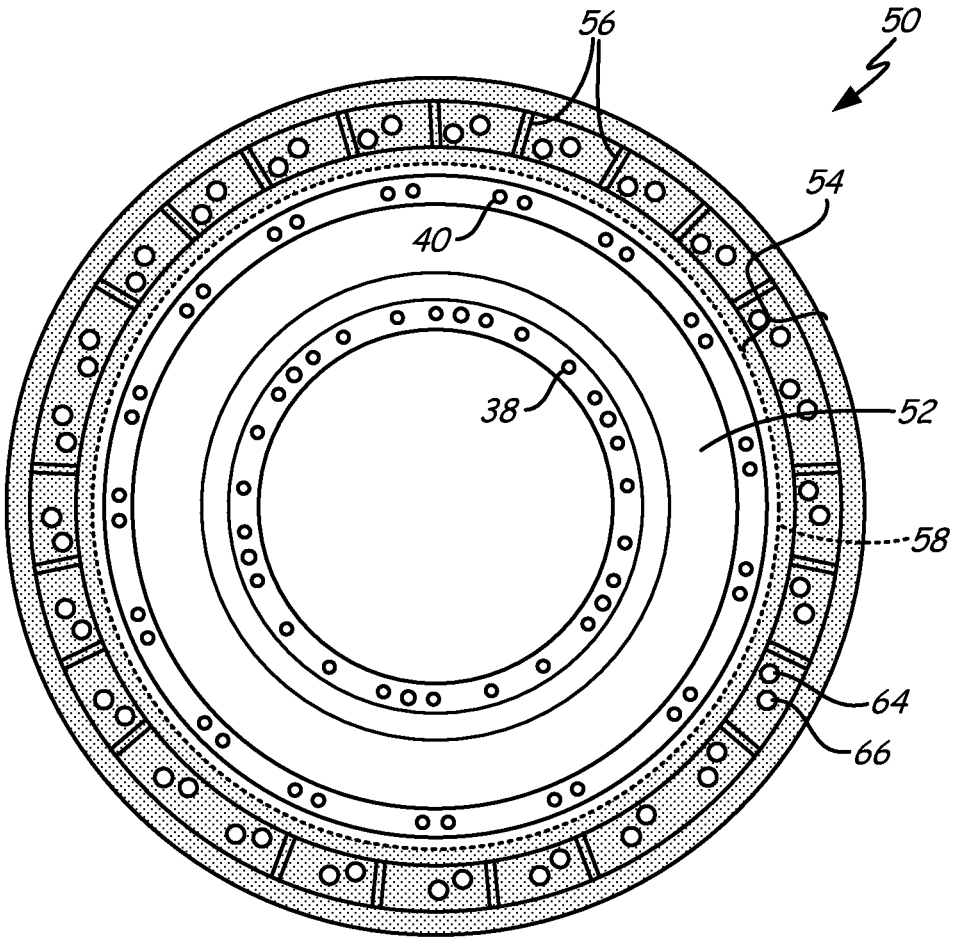
FIG. 5 is a front view of a hybrid radial bearing support disk.

Inventive hybrid bearing support disk 50 is shown in FIG. 5. Hybrid bearing support disk 50 comprises inner hub portion 52 and outer ring portion 54. The bolt holes of inner hub portion 52 are identical to those identified in FIG. 3. Inner hub portion 52 may be Inconel 718, Rene '41, Nimonic 80A and other alloys known in the art. In the embodiment, inner hub portion 52 is fabricated from Inconel 718 alloy by forging, casting, or other methods known in the art.

Outer ring portion 54 is delineated by shading and contains bolt holes 64 and 66 corresponding to bolt holes 34 and 36 in FIG. 3. Outer ring portion 54 may be a nickel base superalloy with superior elevated temperature properties to Inconel 718. Candidates materials for outer ring portion 54, while not being limited to the following, include Waspalloy, Nimonic 901, Udimet 720, and Haynes 282, wherein Haynes 282 is preferred. All these alloys exhibit greater yield strength and corresponding creep strength at temperatures above 1200° F. For comparison, the yield and tensile strengths of Haynes 282 alloy are about 71 and 79 ksi respectively at operating temperatures of about 1600° F. wherein the yield and tensile strengths of Inconel 718 are both less than 50 ksi at those temperatures.

In the embodiment of the present invention, outer ring portion 54 is fabricated by forging, ring rolling, casting, or other methods known in the art. Hub portion 52 is attached to outer ring portion 54 of hybrid disk 50 along dotted boundary line 58 by welding, bolting, riveting, brazing, or other joining methods known to those in the art. Welding may be by arc welding, electron beam welding, laser beam welding, friction stir welding, or by other welding means known in the art. Radial slots 56 are formed in outer ring portion 54 as shown and are identical to slots 46 shown in disk 30 in FIG. 3.

Haynes 282 is a nickel base alloy with the following composition in weight %:

| C | Cr | Ni | Mo | Fe | Co | Ti | Al | Mn | Si |
|---|---|---|---|---|---|---|---|---|---|
| 0.06 | 20 | 57 | 8.5 | 1.5 | 10 | 2.1 | 1.5 | <0.3 | <0.15 |

plus minor alloying additions.

The alloy is strengthened by age hardening following a solution anneal at 1850° F. for two hours followed by an air cool. Age hardening at 1450° F. for eight hours followed by an air cool results in precipitation of coherent gamma prime, $Ni_3(Al,Ti)$, strengthening phase. The alloy has excellent properties (creep strength and microstructural stability) in the 1200-1700° F. temperature range, thereby surpassing those of Inconel 718. With a lower iron content than Inconel 718, Haynes 282 is a higher cost alloy.

Figure 6:
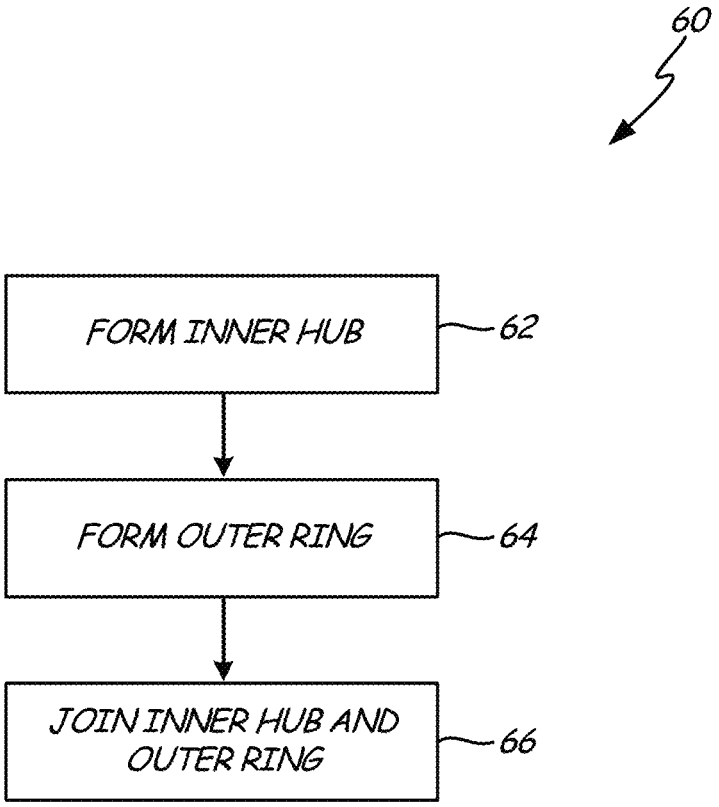
FIG. 6 is a flow diagram of a method of forming a hybrid radial gas turbine engine component.

A method of forming hybrid radial bearing support disk 50 is shown in FIG. 6. Hybrid disk 50 is comprised of inner hub 52 and outer ring portion 54. To form hybrid disk 50, inner hub portion 52 is first fabricated (Step 62). The inner hub of an embodiment of the present invention is fabricated from Inconel 718 alloy. The hub may be formed by forging, casting, or other methods known in the art. Outer ring portion 54 of hybrid disk 50 is then formed (Step 64). The outer ring portion of the embodiment of the present invention is fabricated from Haynes 282 alloy. The ring portion may be formed by forging, casting, or other methods known in the art. Hybrid disk 50 is then formed by joining inner hub 52 and outer ring portion 54 (Step 66). The components are joined by welding, bolting, riveting, brazing, or other methods known in the art. Welding may be by arc welding, electron beam welding, laser beam welding, friction stir welding, or by other welding means known in the art.

Discussion of Possible Embodiments

The following are non-exclusive descriptions of possible embodiments of the present invention.

A hybrid radial gas turbine engine component can include an inner hub portion of a first alloy designed to operate at temperatures less than 1200° F. joined to an outer ring portion of a second alloy designed to operate for extended periods at temperatures greater than 1200° F., wherein the second alloy has greater yield strength and corresponding creep strength than the first alloy at temperatures above 1200° F.

The engine component of the preceding paragraph can optionally include, additionally, and/or alternatively any, one or more of the following features, configurations and/or additional components:

the first alloy of the inner hub portion can be a superalloy selected from the group comprising Inconel 718, René 41, and Nimonic 80A alloys;

the inner hub portion can be Inconel 718 alloy;

the inner hub portion can have yield and tensile strengths of about 150 and 170 ksi, respectively at temperatures of about 1200° F.;

the component can be formed by forging or casting;

the second alloy of the outer ring portion can be a superalloy selected from the group comprising Haynes 282 alloy, Waspalloy, Nimonic 901 and Udimet 720 alloy;

the outer ring portion can be Haynes 282 alloy;

the outer ring portion can have yield and tensile strengths of about 71 and 79 ksi, respectively at temperatures of about 1600° F.;

the outer ring portion can be formed by forging, ring rolling, or casting;

the inner hub portion can be joined to the outer ring portion by welding, bolting, riveting, or brazing;

welding can comprise at least one of arc welding, electron beam welding, laser beam welding, or friction stir welding.

A method can comprise: forming an inner hub portion designed to operate for extended periods at temperatures less than 1200° F.; forming an outer ring portion designed to operate for extended periods at temperatures greater than 1200° F.; and joining the inner hub portion and the outer ring portion to form a hybrid radial gas turbine engine component.

The method of the preceding paragraph can optionally include, additionally and/or alternatively any, one or more of the following features, configurations and/or additional components:

the inner hub portion can be a superalloy selected from the group comprising Inconel 718, René 41, and Nimonic 80A alloys;

the inner hub portion can be Inconel 718 alloy;

the inner hub portion can have yield and tensile strengths of about 150 and 170 ksi, respectively at temperatures of about 1200° F.;

the inner hub portion can be formed by forging or casting;

the outer ring portion can be a superalloy selected from the group comprising Haynes 282 alloy, Waspalloy, Nimonic 901, and Udimet 720 alloy;

the outer ring portion can be Haynes 282 alloy;

the outer ring portion can have yield and tensile strengths of about 71 and 79 ksi, respectively at temperatures of about 1600° F.;

the inner hub portion can be joined to the outer ring portion by welding, bolting, riveting, or brazing;

welding can comprise at least one of arc welding, electron beam welding, laser beam welding, or friction stir welding.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of forming a hybrid radial gas turbine engine component comprising:

forming an inner hub portion of a first alloy designed to operate for extended periods at temperatures less than 1200° F.;

forming an outer ring portion of a second alloy designed to operate for extended periods at temperatures greater than 1200° F., the second alloy having greater yield strength and corresponding creep strength than the first alloy at temperatures above 1200° F.; and joining the inner hub portion and the outer ring portion via welding, bolting, riveting, or brazing to form the hybrid radial gas turbine engine component.

2. The method of claim 1, wherein the first alloy is a superalloy selected from the group comprising Inconel 718, Rene '41, and Nimonic 80A alloys.

3. The method of claim 2, wherein the first alloy is Inconel 718 alloy.

4. The method of claim 3, wherein the first alloy has yield and tensile strengths of about 150 and 170 ksi respectively at temperatures of about 1200° F.

5. The method of claim 3, wherein the inner hub portion is formed by forging or casting.

6. The method of claim 1, wherein the second alloy is a superalloy selected from the group comprising Haynes 282 alloy, Waspalloy, Nimonic 901, and Udimet 720 alloys.

7. The method of claim 6, wherein the second alloy is Haynes 282 alloy.

8. The method of claim 7, wherein the second alloy has yield and tensile strengths of about 71 and 79 ksi respectively at temperatures of about 1600° F.

9. The method of claim 1, wherein joining the inner hub portion and the outer ring portion comprises welding comprising at least one of arc welding, electron beam welding, laser beam welding, and friction stir welding.

* * * * *